US010988701B2

(12) United States Patent
Zhang et al.

(10) Patent No.: US 10,988,701 B2
(45) **Date of Patent: *Apr. 27, 2021**

(54) LUBRICATING COMPOSITION CONTAINING AN OXYALKYLATED HYDROCARBYL PHENOL

(71) Applicant: The Lubrizol Corporation, Wickliffe, OH (US)

(72) Inventors: Yanshi Zhang, Solon, OH (US); Gary M. Walker, Allestree (GB); Ewan E. Delbridge, Concord Township, OH (US); Edward P. Sampler, Leicestershire (GB); Neil L. Simpson, Oldham (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/452,913

(22) Filed: Jun. 26, 2019

(65) Prior Publication Data

US 2019/0316057 A1 Oct. 17, 2019

Related U.S. Application Data

(63) Continuation of application No. 14/894,087, filed as application No. PCT/US2014/033323 on Apr. 8, 2014, now abandoned.

(60) Provisional application No. 61/828,736, filed on May 30, 2013.

(51) Int. Cl.

| | |
|---|---|
| ***C10M 135/10*** | (2006.01) |
| ***C10M 145/36*** | (2006.01) |
| ***C10M 145/26*** | (2006.01) |
| ***C10M 145/38*** | (2006.01) |
| ***C10M 129/16*** | (2006.01) |
| ***C10M 129/50*** | (2006.01) |
| *C10N 20/04* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 30/12* | (2006.01) |
| *C10N 30/00* | (2006.01) |
| *C10N 40/25* | (2006.01) |

(52) U.S. Cl.

CPC ..... *C10M 135/10* (2013.01); *C10M 129/16* (2013.01); *C10M 129/50* (2013.01); *C10M 145/26* (2013.01); *C10M 145/36* (2013.01); *C10M 145/38* (2013.01); *C10M 2203/1006* (2013.01); *C10M 2203/1025* (2013.01); *C10M 2205/04* (2013.01); *C10M 2207/026* (2013.01); *C10M 2207/028* (2013.01); *C10M 2207/04* (2013.01); *C10M 2207/262* (2013.01); *C10M 2207/28* (2013.01); *C10M 2209/10* (2013.01); *C10M 2209/104* (2013.01); *C10M 2209/105* (2013.01); *C10M 2209/106* (2013.01); *C10M 2209/107* (2013.01); *C10M 2209/109* (2013.01); *C10M 2215/064* (2013.01); *C10M 2215/28* (2013.01); *C10M 2219/022* (2013.01); *C10M 2219/046* (2013.01); *C10M 2219/089* (2013.01); *C10M 2223/045* (2013.01); *C10N 2020/04* (2013.01); *C10N 2030/02* (2013.01); *C10N 2030/04* (2013.01); *C10N 2030/041* (2020.05); *C10N 2030/06* (2013.01); *C10N 2030/10* (2013.01); *C10N 2030/12* (2013.01); *C10N 2030/42* (2020.05); *C10N 2030/43* (2020.05); *C10N 2030/45* (2020.05); *C10N 2030/52* (2020.05); *C10N 2030/54* (2020.05); *C10N 2040/25* (2013.01); *C10N 2040/252* (2020.05); *C10N 2040/253* (2020.05); *C10N 2040/255* (2020.05)

(58) Field of Classification Search

CPC ..... C10N 2010/04; C10N 2040/252
USPC ..... 508/391
See application file for complete search history.

(56) References Cited

U.S. PATENT DOCUMENTS

| | | | |
|---|---|---|---|
| 2,620,302 | A | 12/1952 | Harle et al. |
| 2,620,304 | A | 12/1952 | Stewart et al. |
| 2,620,305 | A | 12/1952 | Stewart et al. |
| 2,681,315 | A | 6/1954 | Tongberg et al. |
| 2,833,717 | A | 5/1958 | Whitacre et al. |
| 2,921,027 | A | 1/1960 | Brennan et al. |
| 3,933,662 | A | 1/1976 | Lowe et al. |
| 4,402,845 | A | 9/1983 | Zoleski et al. |
| 4,438,005 | A | 3/1984 | Zoleski et al. |
| 4,479,882 | A | 10/1984 | Zoleski et al. |
| 4,493,776 | A | 1/1985 | Zoleski et al. |
| 4,973,414 | A | 11/1990 | Nerger et al. |
| 2004/0077507 | A1 | 4/2004 | Lange et al. |

(Continued)

FOREIGN PATENT DOCUMENTS

| | | | |
|---|---|---|---|
| EP | 2374866 | A1 | 10/2011 |
| EP | 2682451 | A | 1/2014 |

*Primary Examiner* — Vishal V Vasisth
(74) *Attorney, Agent, or Firm* — Michael A. Miller

(57) ABSTRACT

The invention provides lubricating composition comprising: an oil of lubricating viscosity, and an oxyalkylated hydrocarbyl phenol, wherein the oxyalkylated hydrocarbyl phenol is substituted with at least one aliphatic hydrocarbyl group of 40 to 96 carbon atoms, and wherein the oxyalkylated hydrocarbyl phenol is substantially free of aromatic hydrocarbyl groups. The invention further relates to a method of lubricating a mechanical device (such as an internal combustion engine) with the lubricating composition. The invention further relates to the use of the oxyalkylated hydrocarbyl phenol in the lubricating composition to a passenger car internal combustion engine at least one of (i) control of fuel economy, (ii) control of corrosion, (iii) cleanliness, and (iv) control of bore wear.

7 Claims, No Drawings

(56) References Cited

U.S. PATENT DOCUMENTS

| | | | | |
|---|---|---|---|---|
| 2006/0183647 | A1 | 8/2006 | Kocsis et al. | |
| 2007/0232503 | A1* | 10/2007 | Haigh | C10M 111/02 508/192 |
| 2011/0023978 | A1 | 10/2011 | Dambacher et al. | |

* cited by examiner

LUBRICATING COMPOSITION CONTAINING AN OXYALKYLATED HYDROCARBYL PHENOL

CROSS-REFERENCE TO RELATED APPLICATION

This application is a continuation of U.S. application Ser. No. 14/894,087 filed on Nov. 25, 2015, which claims priority from PCT/US2014/033323 filed on Apr. 8, 2014, which claims the benefit of U.S. Provisional Application Ser. No. 61/828,736 filed on May 30, 2013.

FIELD OF INVENTION

The invention provides lubricating composition comprising: an oil of lubricating viscosity, and an oxyalkylated hydrocarbyl phenol, wherein the oxyalkylated hydrocarbyl phenol is substituted with at least one aliphatic hydrocarbyl group of 40 to 96 carbon atoms, and wherein the oxyalkylated hydrocarbyl phenol is substantially free of aromatic hydrocarbyl groups. The invention further relates to a method of lubricating a mechanical device (such as an internal combustion engine) with the lubricating composition. The invention further relates to the use of the oxyalkylated hydrocarbyl phenol in the lubricating composition to a passenger car internal combustion engine at least one of (i) control of fuel economy, (ii) control of corrosion, (iii) cleanliness, and (iv) control of bore wear.

BACKGROUND OF THE INVENTION

Detergents and dispersants are known to assist in maintaining reduced amounts of deposits on engine components. The lubricant industry has a number of engine tests used to evaluate lubricant's ability to handle deposits and sludge including the Sequence VG, Sequence IIIG, Volkswagen TDI, Caterpillar 1N, and Mercedes Benz OM501LA.

With recent changes to engine specifications there is an increasing demand on the lubricant to reduce deposits, especially soot deposits that are known to accumulate in diesel engines but not gasoline engines. For instance, the ILSAC GF-5 specification requires a 4.0 piston merit rating in the Sequence IIIG (vs. 3.5 for GF-4).

U.S. Pat. No. 3,933,662 (Lowe, published 20 Jan. 1976) discloses mono-ester polyalkoxylated compounds combined with alkaline earth metal carbonates dispersed in a hydrocarbon medium to provide lubricating compositions of superior acid neutralizing capability and rust inhibition in internal combustion engines. The internal combustion engine tested is a Sequence IIB gasoline engine. The Sequence IIB gasoline engine test evaluates valve guide rust and pitting.

U.S. Pat. No. 4,402,845 (Zoleski et al., published 6 Sep. 1983) discloses improved spreadability of marine diesel cylinder oils by the incorporation therein of a polyethylene glycol of the formula: $R—CH_2O—(CH_2CH_2O)_nH$ wherein n ranges from 7 to 40 and R is an alkyl group containing from 11 to 15 carbon atoms.

U.S. Pat. No. 4,438,005 (Zoleski et al., published 20 Mar. 1984) discloses improved spreadability of marine diesel engine cylinder lubricants by the incorporation therein of a spreadability improving amount of at least one polyoxyethylene ester of the formula disclosed therein: wherein n ranges from 18 to 22 and R is an alkyl group having 11 to 17 carbon atoms in the chain.

U.S. Pat. No. 4,479,882 (Zoleski et al., published 30 Oct. 1984) discloses improved spreadability of marine diesel cylinder oils by the incorporation therein of a spreadability improving amount of a polyethoxylated phenoxy compound having the formula disclosed therein: wherein R is an aliphatic hydrocarbyl group having from 5 to 70 carbon atoms and n ranges from 14 to 30.

U.S. Pat. No. 4,493,776 (Rhodes, published 15 Jan. 1985) discloses a lubricating composition with improved rust and corrosion inhibition comprising an additive that is a combination of (A) $R^1O[C_2H_4O]_xH$ and/or $R^2O[C_3H_6O]_yH$ with (B) $R^3O[C_2H_4O]_x[C_3H_6O]_yH$ and/or $R^4O[C_3H_6O]_y[C_2H_4O]_xH$, wherein $R^1$, $R^2$, $R^3$ and $R^4$ are hydrocarbyl radicals selected from alkyl, aryl, alkaryl, and arylalkyl groups or combinations thereof having from about 10 to about 24 carbon atoms; and wherein x and y may vary independently in the range from 3 to about 15. The additives are hydroxyl-terminated.

U.S. Pat. No. 4,973,414 (Nerger et al., published 27 Nov. 1990) discloses monofunctional polyethers having hydroxyl groups contain, as built-in terminal groups or monomers, (a) 1 to 30% by weight of one or more C4- to C24-alkylmonophenols, (b) 1 to 30% by weight of one or more C8- to C24-monoalkanols, (c) 1 to 30% by weight of one or more C10- to C20-1,2-epoxyalkanes and (d) 45 to 80% by weight of propylene oxide or a lower alkylene oxide mixture consisting mainly of propylene oxide the sum of components (a) to (d) adding up to 100% by weight, and have average molecular weights of 600 to 2,500.

Polyalkoxylated compounds are also disclosed in U.S. Pat. No. 2,681,315 (Tongberg, published 15 Jun. 1954) and U.S. Pat. No. 2,833,717 (Whitacre, published 6 May 1958) teaching lubricating oil compositions containing poly(oxyethylene)alkylphenols useful as rust or corrosion-inhibiting additives.

U.S. Pat. No. 2,921,027 (Brennan 12 Jan. 1960) teaches poly(oxyethylene)sorbitan fatty acid ester as a rust inhibitor.

1,2-poly(oxyalkylene)glycol lubricating compositions are disclosed in U.S. Pat. No. 2,620,302 (Harle, published 2 Dec. 1952), U.S. Pat. No. 2,620,304 (Stewart et al., published 2 Dec. 1952), and U.S. Pat. No. 2,620,305 (Stewart et al., published 2 Dec. 1952).

US 2011/0239978 (Dambacher et al, published 6 Oct. 2011) discloses a lubricating composition that contains as an additive component, an oil-soluble mixture of oxyalkylated hydrocarbyl phenol condensates wherein the oxyalkyl groups have the formula —(R'O)n- where R' is an ethylene, propylene or butylene group; and n is independently from 0 to 10; wherein less than 45 mole % of the phenolic functional groups of the condensates are non-oxyalkylated; and more than 55 mole % of the phenolic functional groups of the condensates are mono-oxyalkylated.

Research Disclosure RD 417045 (Anon, published 10 Jan. 1999) describes ethoxylated methylene-bridged alkyl phenols as detergents.

SUMMARY OF THE INVENTION

The objectives of the present invention include providing at least one of (i) control of fuel economy, (ii) control of corrosion, (iii) cleanliness (typically control of deposits, typically control/reduction of soot), and (iv) control of bore wear in an internal combustion engine, typically a diesel passenger car internal combustion engine.

As used herein, reference to the amounts of additives present in the lubricating composition disclosed are quoted on an oil free basis, i.e., amount of actives, unless otherwise indicated.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel, and essential characteristics of the composition or method under consideration.

As used herein the term "oxyalkylated hydrocarbyl phenol" is intended to include un-substituted and substituted compounds that have a hydroxyl group directly bonded aromatic group (within the definition of Mickel Rule 4n+2 electrons) such as phenol, or ortho-, meta- or para-methyl phenol i.e., cresol.

In one embodiment the present invention provides a lubricating composition comprising: an oil of lubricating viscosity, and an oxyalkylated hydrocarbyl phenol, wherein the oxyalkylated hydrocarbyl phenol is substituted with at least one aliphatic hydrocarbyl group of 40 to 96 carbon atoms, and wherein the oxyalkylated hydrocarbyl phenol is substantially free of aromatic hydrocarbyl groups.

In one embodiment the invention provides a lubricating composition characterised as having at least one of (i) a sulphur content of 0.2 wt % to 0.4 wt % or less, (ii) a phosphorus content of 0.08 wt % to 0.15 wt %, and (iii) a sulphated ash content of 0.5 wt % to 1.5 wt % or less.

In one embodiment the invention provides a lubricating composition characterised as having (i) a sulphur content of 0.5 wt % or less, (ii) a phosphorus content of 0.1 wt % or less, and (iii) a sulphated ash content of 0.5 wt % to 1.5 wt % or less.

The lubricating composition may have a SAE viscosity grade of XW-Y, wherein X may be 0, 5, 10, or 15; and Y may be 20, 30, or 40.

In one embodiment the invention provides a method of lubricating an internal combustion engine comprising supplying to the internal combustion engine a lubricating composition of a lubricating disclosed herein.

The internal combustion engine may have a steel surface on a cylinder bore, a cylinder block, or a piston ring.

The internal combustion engine may be a heavy duty diesel internal combustion engine.

The heavy duty diesel internal combustion engine may have a "technically permissible maximum laden mass" over 3,500 kg. The engine may be a compression ignition engine or a positive ignition natural gas (NG) or LPG (liquefied petroleum gas) engine. The internal combustion engine may be a passenger car internal combustion engine. The passenger car engine may be operated on unleaded gasoline. Unleaded gasoline is well known in the art and is defined by British Standard BS EN 228:2008 (entitled "Automotive Fuels—Unleaded Petrol—Requirements and Test Methods").

The passenger car internal combustion engine may have a reference mass not exceeding 2610 kg.

The invention may also provide for a method of controlling soot formation in a 4-stroke compression ignition engine or a positive ignition natural gas (NG) or LPG engine comprising supplying to the engine a lubricating composition disclosed herein.

In one embodiment the invention provides for the use of the oxyalkylated hydrocarbyl phenol disclosed herein in a lubricating composition provide at least one of (i) control of fuel economy, (ii) control of corrosion, (iii) cleanliness (typically control of deposits, typically control/reduction of soot), and (iv) control of bore wear in an internal combustion engine. Typically the internal combustion engine is a diesel passenger car internal combustion engine.

In one embodiment the invention provides for the use of the oxyalkylated hydrocarbyl phenol disclosed herein in a lubricating composition for a diesel passenger car internal combustion engine to control soot deposit formation.

DETAILED DESCRIPTION OF THE INVENTION

The present invention provides a detergent, a process to prepare a detergent, a lubricating composition, a method for lubricating an internal combustion engine and the use as disclosed above.

Oxyalkylated Hydrocarbyl Phenol

The oxyalkylated hydrocarbyl phenol may be represented by the formula:

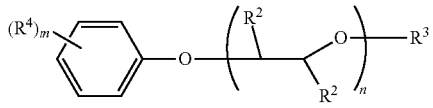

wherein each $R^2$ is independently hydrogen or a hydrocarbyl group of 1 to 6 carbon atoms; $R^3$ is hydrogen, a hydrocarbyl group of 1 to 24 carbon atoms, or an acyl group represented by —C(=O)$R^5$, $R^5$ is a hydrocarbyl group of 1 to 24 carbon atoms;

each $R^4$ is independently a hydrocarbyl group of 1 to 220 carbon atoms, wherein at least one $R^4$ contains 35 to 140, or 40 to 96 carbon atoms;

n=1 to 10; and m=1 to 3.

The oxyalkylated hydrocarbyl phenol may be represented by the formula:

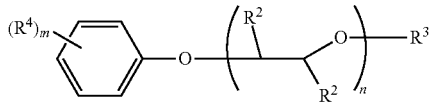

wherein one $R^2$ is methyl, and the second $R^2$ is hydrogen;

$R^3$ is hydrogen, a hydrocarbyl group of 1 to 24 carbon atoms, or an acyl group represented by —C(=O)$R^5$, $R^5$ is a hydrocarbyl group of 1 to 24 carbon atoms;

each $R^4$ is a hydrocarbyl group of 35 to 140, or 40 to 96 carbon atoms;

n=1 to 10; and m=1.

The oxyalkylated hydrocarbyl phenol may be represented by the formula:

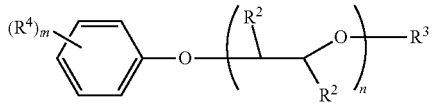

wherein one $R^2$ is methyl, and the second $R^2$ is hydrogen;

$R^3$ is hydrogen, a hydrocarbyl group of 1 to 24 carbon atoms, or an acyl group represented by —C(=O)$R^5$, $R^5$ is a hydrocarbyl group of 1 to 24 carbon atoms;

$R^4$ is a hydrocarbyl group of 1 to 220 carbon atoms, wherein at least one $R^4$ comprises a polyalk(en)yl group containing 35 to 140, or 35 to 96 carbon atoms;

n=2 to 8; and m=1.

The oxyalkylated hydrocarbyl phenol may be represented by the formula:

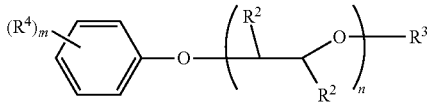

wherein one $R^2$ is methyl, and the second $R^2$ is hydrogen;

$R^3$ is hydrogen, a hydrocarbyl group of 1 to 24 carbon atoms, or an acyl group represented by —C(=O)$R^5$, $R^5$ is a hydrocarbyl group of 1 to 24 carbon atoms;

each a hydrocarbyl group of 1 to 220 carbon atoms comprises a polyisobutenyl group containing 35 to 140, or 35 to 96 carbon atoms;

n=2 to 8 (or 3 to 5); and m=1.

The $R^4$ group of each of the formulae above may be located in the para-position relative to the oxyalkylated group, and the resultant formula is represented by structure:

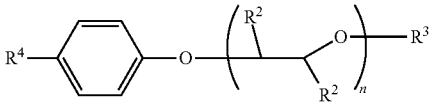

wherein variables $R^2$ to $R^5$, n, and m are defined previously.

In one embodiment the oxyalkylated hydrocarbyl phenol of the present invention is represented by the formula:

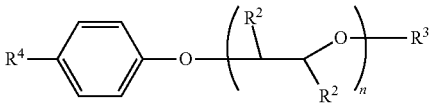

wherein $R^4$ is a polyolefinic group such as a polypropenyl or a polyisobutenyl group (typically a polyisobutenyl group), and variables $R^2$, $R^3$, $R^5$, and n are defined previously. The polyisobutenyl group may have a number average molecular weight of 350 to 2500, or 550 to 2300, or 750 to 1150. In one embodiment the polyisobutenyl group has a number average molecular weight of 950-1000. The polypropenyl group may have a number average molecular weight of 740 to 1200, or 800-850. In one embodiment the polypropenyl group has a number average molecular weight of 825.

In one embodiment the oxyalkylated hydrocarbyl phenol of the present invention is represented by the formula:

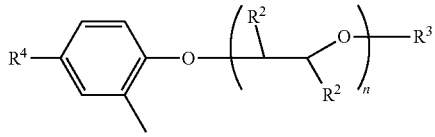

wherein $R^4$ is a polyolefinic group such as a polypropenyl or a polyisobutenyl group (typically a polyisobutenyl group), and variables $R^2$, $R^3$, $R^5$, and n, are defined previously. The polyisobutenyl group may have a number average molecular weight of 350 to 2500, or 550 to 2300, or 750 to 1150. In one embodiment the polyisobutenyl group has a number average molecular weight of 950-1000.

The oxyalkylated group of the oxyalkylated hydrocarbyl phenol has formula —$(R^1O)_n$—, wherein $R^1$ is an ethylene, propylene, butylene group, or mixtures thereof; and n may independently be from 1 to 50, or 1 to 20, or 1 to 10, or 2 to 5.

The oxyalkylated group of the oxyalkylated hydrocarbyl phenol may be either a homopolymer or copolymer or oligomers thereof. If the oxyalkylated group is in the form of a copolymer, or oligomer thereof, the oxyalkylated group may have either random or block architecture.

In one embodiment the oxyalkylated group (or $R^1$ is a propylene, or butylene group i.e., the oxyalkylated group does not require an ethylene group. If an ethylene group is present the oxyalkylate group may be a copolymer, or oligomer thereof with either propylene or butylene oxide i.e., blocks of (i) —$CH_2$ $CH_2O$— with (ii) —$CH_2$ $CH_2CH_2CH_2O$— or —$CH_2CH(CH_3)CH_2O$— or —$CH_2CH(CH_3)O$—.

In one embodiment the oxyalkylated group is based upon propylene oxide.

The oxyalkylated hydrocarbyl phenol may be prepared by reacting a hydrocarbyl substituted phenol with an alkylene oxide (typically ethylene oxide, propylene oxide or butylene oxide), optionally in the presence of a base catalyst. Typically the reaction occurs in the presence of a base catalyst.

The base catalyst may include sodium chloroacetate, sodium hydride or potassium hydroxide The aliphatic hydrocarbyl group (also represented by $R^4$) may be linear or branched, typically with at least one branching point. The aliphatic hydrocarbyl group typically has one, although it may in some embodiments be desirable to have to $R^4$ groups, with the second group being methyl. If a second $R^4$ group is present and is methyl, then the oxyalkylated hydrocarbyl phenol is a cresol.

In different embodiments the oxyalkylated hydrocarbyl phenol of the present invention may be present in an amount ranging from 0.01 wt % to 5 wt %, or 0.05 to 3 wt %, or 0.1 to 1.5 wt % of the lubricating composition. Typically the oxyalkylated hydrocarbyl phenol is present in an amount from 0.1 to 1.5 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/

147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

A lubricating composition may be prepared by adding the oxyalkylated hydrocarbyl phenol described herein to an oil of lubricating viscosity, optionally in the presence of other performance additives (as described herein below).

The lubricating composition of the invention may further include other additives. In one embodiment the invention provides a lubricating composition further comprising at least one of a dispersant, an antiwear agent, a dispersant viscosity modifier, a friction modifier, a viscosity modifier, an antioxidant, an overbased detergent, a foam inhibitor, a demulsifier, a pour point depressant or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The lubricating composition disclosed herein may further comprise an overbased detergent. The overbased detergent may be selected from the group consisting of non-sulphur containing phenates, sulphur containing phenates, sulphonates, salixarates, salicylates, and mixtures thereof. In one embodiment the overbased detergent may be selected from the group consisting of non-sulphur containing phenates, sulphur containing phenates, sulphonates and mixtures thereof.

Typically an overbased detergent may be sodium, calcium or magnesium (typically calcium) salt of the phenates, sulphur containing phenates, sulphonates, salixarates and salicylates. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378

The overbased metal-containing detergent may also include "hybrid" detergents formed with mixed surfactant systems including phenate and/or sulphonate components, e.g., phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Overbased detergents are known in the art. Overbased materials, otherwise referred to as overbased or superbased salts, are generally single phase, homogeneous Newtonian systems characterised by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

The overbased detergent may be present at 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition comprises at least one overbased detergent with a metal ratio of at least 3, or at least 8, or at least 15. In one embodiment, the overbased detergent may be present in an amount to deliver total base number (TBN) of at least 3 mg KOH/g to the lubricating composition or at least 4 mg KOH/g, or at least 5 mg KOH/g to the lubricating composition; the overbased detergent may deliver 3 to 10 mg KOH/g, or 5 to 10 mg KOH/g to the lubricating composition.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the invention does include a dispersant or mixtures thereof. The dispersant may be present as a single dispersant. The dispersant may be present as a mixture of two or more (typically two or three) different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylene-pentamine, pentaethylenehexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

In one embodiment the dispersant may be borated or non-borated. Typically a borated dispersant may be a succinimide dispersant. In one embodiment, the ashless dispersant is boron-containing, i.e., has incorporated boron and delivers said boron to the lubricant composition. The boron-containing dispersant may be present in an amount to deliver at least 25 ppm boron, at least 50 ppm boron, or at least 100 ppm boron to the lubricant composition. In one embodiment, the lubricant composition is free of a boron-containing dispersant, i.e. delivers no more than 10 ppm boron to the final formulation.

The dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6.

The dispersant may be present at 0 wt % to 20 wt %, 0.1 wt % to 15 wt %, or 0.5 wt % to 9 wt %, or 1 wt % to 8.5 wt % of the lubricating composition.

In one embodiment the lubricating composition may be a lubricating composition further comprising a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Antioxidants include sulphurised olefins, diarylamines, alkylated diarylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenyl amine, octyl diphenyl amine, di-octylated diphenyl amine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalised with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; 6,117,825; and 7,790,661. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment the dispersant viscosity modifier may include those described in U.S. Pat. No. 7,790,661 column 2, line 48 to column 10, line 38.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

In one embodiment the friction modifier may be selected from the group consisting of long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartaric acid derivatives such as tartrate esters, amides or tartrimides, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

The lubricating composition may further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid monoester of glycerol, often the fatty acid is oleic acid.

In one embodiment, the oil soluble titanium compound is a titanium carboxylate. In one embodiment the titanium (IV) carboxylate is titanium neodecanoate.

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof different from the non-hydroxy terminated acylated polyalkylene oxide of the invention.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulpholene derivatives Exxon Necton-37 ™ (FN 1380) and Exxon Mineral Seal Oil™ (FN 3200).

An engine lubricating composition in different embodiments may have a composition as disclosed in the following table:

| | Embodiments (wt %) | | |
|---|---|---|---|
| Additive | A | B | C |
| oxyalkylated hydrocarbyl phenol | 0.01 to 5 | 0.05 to 3 | 0.1 to 1.5 |
| Overbased Detergent | 2 to 9 | 3 to 8 | 3 to 5 |
| Dispersant Viscosity Modifier | 0 to 5 | 0 to 4 | 0.05 to 2 |
| Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

INDUSTRIAL APPLICATION

In one embodiment the invention provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an exhaust gas recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. Diesel fueled engines may be fueled with a mixture of conventional diesel fuel and bio-derived diesel fuel (i.e. bio-diesel). In one embodiment the diesel engine fuel may comprise 5 volume percent to 100 volume percent bio-diesel (i.e. B5 to b100); in one embodiment the diesel fuel comprises 5 volume percent to 50 volume percent bio-diesel or 8 volume percent to 30 volume percent bio-diesel. In one embodiment the diesel fuel is substantially free of (i.e. contains less than 1 volume percent) bio-diesel. In one embodiment the internal combustion engine may be a heavy duty diesel engine. In one embodiment, the internal combustion engine may be a gasoline direct injection (GDI) engine. When the internal combustion engine is a gasoline engine, and the oxyalkylated group of the oxyalkylated hydrocarbyl phenol of the present invention has formula —$(R^1O)_n$—, wherein 10 is ethylene, propylene, butylene group, or mixtures thereof, with the proviso that if 10 comprises ethylene groups the resultant oxyalkylated hydrocarbyl phenol is a random or block copolymer derived from ethylene glycol and either (i) propylene glycol or (ii) butylene glycol; and n is independently from 1 to 50, or 1 to 20.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine). In one embodiment the internal combustion engine is a 4-stroke engine, and is a compression ignition engine or a positive ignition natural gas (NG) or LPG engine.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.2 wt % or 1.1 wt % of the lubricating composition. In one embodiment the sulphated ash content may be 0.5 wt % to 1.2 wt % of the lubricating composition. The TBN (as measured by ASTM D2896) of the engine oil lubricant may be 5 mg KOH/g to 15 mg KOH/g, or 6 mg KOH/g to 12 mg KOH/g, or 7 mg KOH/g to 10 mg KOH/g.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

The following examples provide illustrations of the invention. These examples are non-exhaustive and are not intended to limit the scope of the invention.

EXAMPLES

Inventive Preparative Example a (1 Equivalents of Ethylene Oxide to 1 Equivalent of Polyisobutylene Phenol)

Polyisobutylene (950 Mn) phenol (600 g) and KOH pellets (5 g) are charged to the vessel. The vessel is purged 6 times with Nitrogen (0-30 psi) then pressurised to 10 psi. The contents are heated to 130 C with stirring and the vessel is repressurised to 10 psi. Ethylene oxide (20.33 g) is added over 4 hours. Purged cylinder lines and allowed pressure to drop to 12 psi (8 hours). Discharged 626 g of a golden liquid.

Inventive Preparative Example B (1 Equivalents of Propylene Oxide to 1 Equivalent of Polyisobutylene Phenol)

Polyisobutylene (950 Mn) phenol (600 g) and KOH pellets (5 g) are charged to the vessel. The vessel is purged 6 times with Nitrogen (0-30 psi) then pressurised to 10 psi. The contents are heated to 120 C with stirring and the vessel is repressurised to 10 psi. Propylene oxide (26.81 g) is added over 2 hours. Purged cylinder lines and allowed pressure to drop to 12 psi (8 hours). Discharged 632 g of a golden liquid

Inventive Preparative Example C (2 Equivalents of Ethylene Oxide to 1 Equivalent of Polyisobutylene Phenol)

Polyisobutylene (950 Mn) phenol (600 g) and potassium hydroxide pellets (5 g) are charged to a pressurised vessel. The vessel is purged 6 times with nitrogen (0-30 psi) then pressurised to 10 psi. The contents are heated to 130° C. with stirring and the vessel is re-pressurised to 10 psi. Ethylene oxide (40.66 g) is added over 4 hours. The vessel is then depressurised over 8 hours. The product yield is 646 g of a yellow liquid.

Inventive Preparative Example D (2 Equivalents of Propylene Oxide to 1 Equivalent of Polyisobutylene Phenol)

Polyisobutylene (950 Mn) phenol (600 g) and KOH pellets (5 g) are charged to the vessel. The vessel is purged 6 times with Nitrogen (0-30 psi) then pressurised to 10 psi. The contents are heated to 120 C with stirring and the vessel is repressurised to 10 psi. Propylene oxide (53.61 g) is added over 2 hours. Purged cylinder lines and allowed pressure to drop to 12 psi (8 hours). Discharged 659 g of a yellow liquid.

Inventive Preparative Example F (5 Equivalents of Propylene Oxide to 1 Equivalent of Polyisobutylene Phenol)

Polyisobutylene (950 Mn) phenol (550 g) and KOH pellets (4.5 g) are charged to the vessel. The vessel is purged 6 times with Nitrogen (0-30 psi) then pressurised to 10 psi. The contents are heated to 120 C with stirring and the vessel is repressurised to 10 psi. Propylene oxide (122.86 g) is added over 4 hours. Purged cylinder lines and allowed pressure to drop to 12 psi (8 hours). Discharged 678 g of a yellow liquid.

Inventive examples A, B, C, D, and F through V are prepared in a similar fashion and are summarized in Table 1.

TABLE 1

Examples of Oxyalkylated phenols

| | PIB phenol | Alkylene Oxide | EO:PO:BO Ratio* | Degree of Alkoxylation |
|---|---|---|---|---|
| Example A | PP-1 | EO | 1:0:0 | 1 |
| Example B | PP-1 | PO | 0:1:0 | 1 |
| Example C | PP-1 | EO | 1:0:0 | 2 |
| Example D | PP-1 | PO | 0:1:0 | 2 |
| Example E | PP-1 | EO | 1:0:0 | 5 |
| Example F | PP-1 | PO | 0:1:0 | 5 |
| Example G | PP-1 | PO | 0:1:0 | 10 |
| Example H | PP-1 | BO | 0:0:1 | 5 |
| Example I | PP-1 | EO/PO | 1:1:0 | 5 |
| Example J | PP-1 | EO/BO | 1:0:1 | 5 |
| Example K | PP-1 | PO/BO | 0:1:1 | 5 |
| Example L | PP-1 | EO/PO/BO | 1:1:1 | 5 |
| Example J | PP-1 | EO/BO | 1:0:2 | 10 |
| Example L | PP-2 | PO | 0:1:0 | 2 |
| Example M | PP-2 | PO | 0:1:0 | 5 |
| Example N | PP-2 | EO | 1:0:0 | 2 |
| Example O | PP-2 | EO | 1:0:0 | 5 |
| Example P | PP-2 | BO | 0:0:1 | 5 |
| Example Q | PP-2 | EO/PO | 1:1:0 | 5 |
| Example R | PP-2 | EO/BO | 1:0:1 | 5 |
| Example S | PP-2 | PO/BO | 0:1:1 | 5 |
| Example T | PP-2 | EO/PO/BO | 1:1:1 | 5 |
| Example U | PP-3 | PO | 0:1:0 | 5 |
| Example V | PP-4 | PO | 0:1:0 | 5 |

PP-1: 4-Alkylphenol where alkyl is 1000 Mn Pib;
PP-2: 4-Alkylphenol where alkyl is 550 Mn Pib;
PP-3: 4-Alkylphenol where alkyl is 1500 Mn Pib;
PP-4: 4-Alkylphenol where alkyl is 2000 Mn Pib;
*Mixtures represent feed ratios A set of 5W-40 engine lubricants suitable for use in light duty diesel engines are prepared in Group III base oil of lubricating viscosity containing the additives described above as well as conventional additives including polymeric viscosity modifier, ashless succinimide dispersant, overbased detergents, antioxidants (combination of phenolic ester, diarylamine, and sulphurized olefin), zinc dialkyldithiophosphate (ZDDP), as well as other performance additives as follows (Table 2 and 3).

TABLE 2

Lubricating Compositions

| | BL1 | CEX | EX1 | EX2 | EX3 | EX4 | EX5 | EX6 |
|---|---|---|---|---|---|---|---|---|
| Base Oil | Balance to 100% | | | | | | | |
| PP-1 | | 1 | | | | | | |
| Example A | | | 1 | | | | | |
| Example B | | | | 1 | | | | |
| Example C | | | | | 1 | | | |
| Example D | | | | | | 1 | | |
| Example E | | | | | | | 1 | |
| Example F | | | | | | | | 1 |

TABLE 2-continued

| Lubricating Compositions | | | | | | | | |
|---|---|---|---|---|---|---|---|---|
| | BL1 | CEX | EX1 | EX2 | EX3 | EX4 | EX5 | EX6 |
| Calcium Detergents[1] | 1.51 | 1.51 | 1.51 | 1.51 | 1.51 | 1.51 | 1.51 | 1.51 |
| ZDDP[2] | 0.5 | 0.5 | 0.5 | 0.5 | 0.5 | 0.5 | 0.5 | 0.5 |
| Antioxidant[3] | 2 | 2 | 2 | 2 | 2 | 2 | 2 | 2 |
| Dispersant[4] | 4.9 | 4.9 | 4.9 | 4.9 | 4.9 | 4.9 | 4.9 | 4.9 |
| Viscosity Modifier[5] | 1.23 | 1.23 | 1.23 | 1.23 | 1.23 | 1.23 | 1.23 | 1.23 |
| Additional additives[6] | 0.36 | 0.36 | 0.36 | 0.36 | 0.36 | 0.36 | 0.36 | 0.36 |
| % Phos | 0.045 | 0.045 | 0.045 | 0.045 | 0.045 | 0.045 | 0.045 | 0.045 |
| % Sulphur | 0.18 | 0.18 | 0.18 | 0.18 | 0.18 | 0.18 | 0.18 | 0.18 |

[1]Mixture of overbased calcium sulphonate and calcium phenate detergents

[2]Secondary ZDDP derived from mixture of C3 and C6 alcohols

[3]Combination of phenolic and arylamine antioxidants

[4]Succinimide dispersant derived from polyisobutylene

[5]Styrene-diene block copolymer

[6]Additional additives include friction modifier, anti-foam agents, and pourpoint depressants

TABLE 3

| Lubricating Compositions | | | |
|---|---|---|---|
| | BL2 | EX7 | EX8 |
| Base Oil | Balance to 100% | | |
| Example E | | 1 | |
| Example F | | | 1 |
| Calcium Detergents[1] | 1.29 | 1.29 | 1.29 |
| ZDDP[2] | 0.86 | 0.86 | 0.86 |
| Antioxidant[3] | 3.2 | 3.2 | 3.2 |
| Dispersant[4] | 4.97 | 4.97 | 4.97 |
| Viscosity Modifier[5] | 1.44 | 1.44 | 1.44 |
| Additional additives[6] | 0.46 | 0.46 | 0.46 |
| % Phos | 0.077 | 0.077 | 0.077 |
| % Sulphur | 0.25 | 0.25 | 0.25 |

[1]Mixture of overbased calcium sulphonate and calcium phenate detergents

[2]Secondary ZDDP derived from mixture of C3 and C6 alcohols

[3]Combination of phenolic and arylamine antioxidants

[4]Succinimide dispersant derived from polyisobutylene

[5]Styrene-diene block copolymer

[6]Additional additives include friction modifier, anti-foam agents, and pourpoint depressants The formulations are evaluated in both bench oxidation-deposit tests as well as a fired engine test designed to evaluate deposit control of lubricants.

The lubricating compositions are tested in a Panel Coker heated to 325° C., with a sump temperature of 105° C., and a splash/bake cycle of 120 s/45 s. The airflow is 350 ml/min, with a spindle speed of 1000 rpm and the test lasts for 4 hours. The oil is splashed onto an aluminum panel which is then optically rated by computer. Performance ranges from 0% (black panel) to 100% (clean panel). The results obtained are summarized in Table 4.

The lubricating compositions are also evaluated in the Volkswagen (VW) TDI engine test. The test procedure follows the PV1452 and CEC L-78-T-99 methods as laid out in the ACEA oil sequences. This engine test rates lubricants on piston cleanliness (merit) and ring sticking. The results obtained are summarized in Table 5.

TABLE 4

| Deposit Bench Test Results | | | | | | |
|---|---|---|---|---|---|---|
| | BL1 | CEX | EX2 | EX4 | EX5 | EX6 |
| Panel Coker | 80 | 77 | 95 | 92 | 98 | 100 |

The results from Panel Coker tests obtained indicate that the oxyalkylated polyisobutenylphenol significantly outperformed the baseline as well as the polyisobutenylphenol at equal treat rates.

TABLE 5

| Engine Test Results | | | |
|---|---|---|---|
| | BL2 | EX7 | EX8 |
| VW TDI Piston Merit | 61, 63 | 68 | 67 |

The results obtained indicate that the oxyalkylated PIB-phenol significantly outperformed the baseline formulation in terms of deposit control capability.

The present invention is capable of at least one of (i) control of fuel economy, (ii) control of corrosion, (iii) cleanliness (typically control of deposits, typically control/reduction of soot), and (iv) control of bore wear, typically in a passenger car internal combustion engine.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(i) an oil of lubricating viscosity, (ii) 0.1 to 1.5 wt % of an oxyalkylated hydrocarbyl phenol, wherein the oxyalkylated hydrocarbyl phenol is free of aromatic hydrocarbyl groups, wherein the oxyalkylated hydrocarbyl phenol is represented by formula:

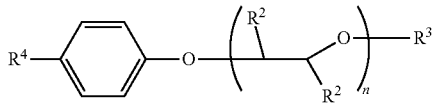

wherein each $R^2$ is independently hydrogen or a hydrocarbyl group of 1 carbon atom;

$R^3$ is hydrogen, $R^4$ is a polyisobutenyl group having a number average molecular weight of 750 to 1,100; and n=3 to 8; and (iii) 0.15 wt % to less than 3 wt % of an overbased calcium sulphonate detergent, wherein the lubricating composition has a total phosphorus content of from 100 ppm to 600 ppm all delivered from zinc dialkyldithiophosphate.

2. The composition of claim 1, wherein the lubricating composition further comprises at least one of (i) a sulphur content of 0.5 wt % or less and (ii) a sulphated ash content of 0.5 wt % to 1.5 wt %.

3. The composition of claim 2, wherein the lubricating composition comprises: (i) a sulphur content of 0.2 wt % to 0.4 wt % or less and (ii) a sulphated ash content of 0.5 wt % to 1.5 wt %.

4. The composition of claim 1, wherein one $R^2$ is methyl and the second $R^2$ is hydrogen.

5. A method of lubricating an internal combustion engine comprising supplying to the internal combustion engine a lubricating composition of claim 1.

6. The method of claim 5, wherein the internal combustion engine is a diesel fueled internal combustion engine.

7. The method of claim 5, wherein the internal combustion engine is a gasoline fueled internal combustion engine.

* * * * *